US012270164B2

(12) United States Patent
Wenger

(10) Patent No.: US 12,270,164 B2
(45) Date of Patent: Apr. 8, 2025

(54) TERMINAL ELEMENT OF A TRAFFIC BARRIER DEVICE, TRANSITION SYSTEM, AND METHOD FOR PROVIDING IMPACT PROTECTION

(71) Applicant: WENGER, PROJEKTE UND COACHING, Morgarten (CH)

(72) Inventor: Hermann Wenger, Morgarten (CH)

(73) Assignee: Wenger, Projekte und Coaching, Morgarten (CH)

( * ) Notice: Subject to any disclaimer, the term of this patent is extended or adjusted under 35 U.S.C. 154(b) by 670 days.

(21) Appl. No.: 16/628,055

(22) PCT Filed: Jul. 12, 2017

(86) PCT No.: PCT/EP2017/067554
§ 371 (c)(1),
(2) Date: Jan. 2, 2020

(87) PCT Pub. No.: WO2019/011425
PCT Pub. Date: Jan. 17, 2019

(65) Prior Publication Data

US 2021/0148072 A1 May 20, 2021

(51) Int. Cl.
*E01F 15/00* (2006.01)
*E01F 15/08* (2006.01)

(52) U.S. Cl.
CPC ..... *E01F 15/006* (2013.01); *E01F 15/088* (2013.01)

(58) Field of Classification Search
CPC ..... E01F 15/006; E01F 15/0415; E01F 15/00; E01F 15/0407; E01F 15/04; E01F 15/088; E01F 15/0423
See application file for complete search history.

(56) References Cited

U.S. PATENT DOCUMENTS 4,629,357 A * 12/1986 Wattenburg ..... E01F 15/006 404/9
4,632,598 A * 12/1986 Richards ..... E01F 15/006 404/9
5,007,763 A * 4/1991 Burgett ..... E01F 15/006 404/9
5,009,542 A * 4/1991 Hardin, Jr. ..... E01F 15/12 404/9
6,402,421 B1 6/2002 Ottavi et al.
(Continued)

FOREIGN PATENT DOCUMENTS

AT 517351 B1 * 1/2017 ..... E01F 15/006
CN 104809888 A * 7/2015
(Continued)

OTHER PUBLICATIONS

International Search Report Corresponding to PCT/EP2017/067554 mailed Apr. 12, 2018.
(Continued)

*Primary Examiner* — Josh Skroupa
*Assistant Examiner* — Zachary A Hall
(74) *Attorney, Agent, or Firm* — Finch & Maloney PLLC

(57) ABSTRACT

A terminal element (100) of a traffic barrier device (1), having a longitudinal axis and comprising a guide element (10) and an impact element (20). The impact element (20) is pivotally mounted on the guide element (10) about an axis (A) which extends parallel to the longitudinal axis (L).

18 Claims, 4 Drawing Sheets

(56) References Cited

U.S. PATENT DOCUMENTS

| | | | | |
|---|---|---|---|---|
| 6,767,158 | B1 * | 7/2004 | Consolazio | E01F 15/088 404/6 |
| 9,073,474 | B2 * | 7/2015 | Dyke | E01F 15/083 |
| 2007/0160420 | A1 * | 7/2007 | Aoki | E01F 15/006 404/6 |
| 2023/0237905 | A1 * | 7/2023 | Kellari | G08G 1/0116 701/24 |

FOREIGN PATENT DOCUMENTS

| | | | | | |
|---|---|---|---|---|---|
| CN | 107354891 | A | * | 11/2017 | E01F 15/006 |
| CN | 116356739 | A | * | 6/2023 | |
| DE | 25 23 291 | A1 | | 5/1976 | |
| DE | 600 14 502 | T2 | | 2/2006 | |
| DE | 102007027453 | A1 | * | 12/2008 | E01F 15/006 |
| EP | 2 784 222 | A1 | | 10/2014 | |
| EP | 2784221 | A1 | * | 10/2014 | E01F 15/006 |
| KR | 101 613 275 | B1 | | 4/2016 | |
| NL | 9001524 | A | * | 2/1992 | E01F 15/006 |
| WO | 2014/127763 | A2 | | 8/2014 | |
| WO | 2017/118620 | A1 | | 7/2017 | |

OTHER PUBLICATIONS

International Search Report Corresponding to PCT/EP2017/067551 mailed Apr. 12, 2018.
Written Opinion Corresponding to PCT/EP2017/067554 mailed Apr. 12, 2018.
Written Opinion Corresponding to PCT/EP2017/067551 mailed Apr. 12, 2018.

* cited by examiner

TERMINAL ELEMENT OF A TRAFFIC BARRIER DEVICE, TRANSITION SYSTEM, AND METHOD FOR PROVIDING IMPACT PROTECTION

This application is a National Stage completion of PCT/EP2017/067554 filed Jul. 12, 2017.

FIELD OF THE INVENTION

The present invention concerns a terminal element of a traffic barrier device, a transition system comprising at least one traffic barrier device with a terminal element and a method for providing a collision protection at a terminal element of a traffic barrier device.

BACKGROUND OF THE INVENTION

Various traffic barrier devices, colloquially also called crash barriers, sure known from the state of the art. The purpose of a traffic barrier device is to retain the vehicle on the roadway in the event of an accident. However, generic lane demarcation devices should make if possible to provide a passage for emergencies or traffic, e.g. if this has to be diverted.

According to the EP 2 784 222 B1, for example, a mobile crash barrier has become known. This mobile crash barrier of the EP 2 784 222 is suitable for use in a transition system. A generic transition system is shown, for example, in DB 600 14 502 T2. Such a transition system is also shown in the PCT application PCT/EP 2017/050042, which has not yet been published. Typically, transition systems have two swiveling traffic barriers or crash barriers. The swiveling system allows a passage to be created which serves as a transition for the vehicles, for example from a first lane to a second lane.

The crash barrier device as shown in EP 2 784 222 has a flap element which can be lowered and can be described as a short turned-down terminal (a special form of standard turned-down terminal). This flap element is arranged at the front of the crash barrier device. The purpose of this short turned-down terminal is to provide collision protection if the crash barrier element is not arranged in line with another crash barrier element and there is a risk that a vehicle could collide with the end face of the crash barrier element. The end face comprises the area of a crash barrier element which terminates the crash barrier element along a longitudinal axis. The longitudinal axis is defined as an axis in the longitudinal direction of the traffic barrier device.

For safety reasons in the event of a vehicle colliding with the traffic barrier device, it is necessary for the traffic barrier device to absorb high longitudinal forces. For this purpose in the state of the art it is provided for connecting individual elements of the traffic barrier devices with each other by means of a locking device in the operating state.

The crash barrier device from EP 2 784 222 B1 has such a locking mechanism. It is incorporated in the flap element, which leads to a complex construction. When the flap element is actuated, high forces are also exerted, caused by torques. When connecting several crash barrier devices, a high degree of precision is required due to the flap element and the locking device arranged within, in order to ensure complete locking.

SUMMARY OF THE INVENTION

It is therefore the object of the invention to eliminate these and other disadvantages of the state of the art. This object is achieved by the devices and procedures defined in the independent patent claims. Further embodiments are disclosed by the dependent patent claims.

A terminal element of a traffic barrier device according to the invention, in particular a device for opening a passage in a traffic barrier device, having a longitudinal axis comprises a guiding element and an impact element. The impact element is rotatable or swivelable relative to the guiding element from a closed position to an impact position. The impact element is mounted on the guiding element on an axis parallel to the longitudinal axis or rotatable or sniveling about this longitudinal axis.

In generic use, the impact side in the impact position of the impact element faces oncoming traffic. The impact side is specifically designed for the impact of a vehicle, in particular as a short turned-down terminal.

Preferably, the impact element has an essentially congruent or similar contour to the guiding element. The contours transverse to the longitudinal axis of the guide element and the impact element are at least partially superposed in the impact position, preferably the superposition in the closed position corresponds essentially to the superposition in the impact position.

The axis parallel to the longitudinal axis is preferably arranged symmetrically in relation to the longitudinal axis in the terminal element.

This enables simple and uncomplicated production as well as simple assembly of the terminal element. In addition, forces on the impact element can be easily absorbed. A corresponding superposition of the contours in the impact position and in the closed position is ensured.

The impact element preferably extends along the longitudinal axis in the closed position and in the impact position.

This fosters force absorption in the longitudinal direction. Leverage effects are reduced or avoided.

Preferably the impact element can be locked in the closed position and/or in the impact position.

Two defined positions make it possible to bring the impact element into two defined operating states. Calculation and construction therefore only have to be calculated in two preferred states. This allows a simplified dimensioning of she elements.

The retaining device enables securing the impact element in the corresponding first or second position and, for example, to protect it against unintentional manipulation.

The impact element can comprise at least a first element of a retaining device.

This enables manufacturing part of the retaining device as an integral part of the impact element. Design and operation are simplified. In addition, good power transmission to the impact element is possible.

The first element of the retaining device can preferably be designed as a remaining opening or as a retaining cylinder. These are proven elements of mechanical engineering and make it possible to provide a simple retaining mechanism.

Such a retaining cylinder is preferably designed as a lifting rotary cylinder. It moves from a first position to a second position and rotates about its cylinder axis in such a way that two or more extensions arranged on the cylinder engage in corresponding openings and interact as bayonet locks.

Preferably, a second element of the retaining device is arranged inside the guiding element.

The second element of the retaining device is thus protected against environmental influences.

The retaining device is preferably hydraulically operable.

Hydraulic actuators are low-maintenance and highly reliable. Since the individual elements in hydraulic devices can be connected by means of flexible lines, individual positioning of the hydraulic actuating device is possible. Space conditions, e.g. within the guiding element, can be well exploited.

The impact element preferably comprises at least a first element of a locking device. This first element of the locking device can be designed as a retaining bolt or as a cylinder. Such a cylinder is preferably designed as a lift-turning cylinder. It moves from a first position to a second position and rotates about its cylinder axis in such a way that two or more extensions arranged on the cylinder engage in corresponding openings and interact as bayonet locks.

This has the advantage that the first element of the locking device interacts reliably with the impact element.

Preferably, the first element of the locking device is arranged inside the impact element. This enables a reliable positioning and also a reliable power transmission of the first element to the impact element. The impact element can be reliably locked.

The design as a retaining bolt or as a cylinder enables reliable and simple locking of the impact element. Both retaining bolts and cylinders are easy to operate elements. This simplifies manipulation and locking of the impact element.

Preferably, the first element of the locking device is arranged inside the impact element.

A reliable fastening of the first element of the locking device is possible, a reliable power transmission is guaranteed. In addition, the first element of the locking device can be protected from environmental influences.

Preferably, the locking device can be operated hydraulically. As explained above, hydraulic actuators are reliable and easy to maintain.

The impact element can have a turned-down terminal, for example a short turned-down terminal or also a standard turned-down terminal. Typically, a turned-down terminal at the impact element is shorter than a short turned-down terminal. This is typically due to the shorter design and mobile use. A turned-down terminal is also one of several forms of collision protection. The impact side is thus specifically designed for the impact of a vehicle.

The guiding element may have an end section at which the impact element is arranged. The impact element is preferably arranged with a slewing ring on the guiding element.

The arrangement of the impact element at the end section makes it possible to create a defined interface. A suspension of the impact element on a slewing ring enables a high stability of the impact element in relation to the guiding element. In addition, simple production is possible.

The impact element can preferably be moved horizontally along the longitudinal arts of the terminal element. This enables changing or adjusting the overall length of the terminal element.

The terminal element can comprise a hydraulic drive for swiveling the impact element. This enables easy and safe swiveling of the impact element.

A further aspect of the invention concerns a transition system comprising at least one traffic barrier device with a terminal element as described above.

This will provide a complete traffic control and guidance system.

The traffic barrier device of the transition system may have, on a side remote from the terminal element, a vertical axis of rotation for pivoting the traffic barrier device relative to a stationary or fixed element of the transition system.

This enables on the one hand a fixed connection of the traffic barrier device with a stationary element, on the other hand it is also possible to swivel said element in relation so a fixed element. For example, a device or undercarriage for pivoting such a lane limiting device is described in the international patent application PCT/EP2017/050042. The traffic barrier device described herein and/or the terminal element described herein may be fitted with a running gear, preferably a running gear described in the abovementioned international patent application.

A further aspect of the invention concerns a method for providing an impact protection on an terminal element of a traffic barrier device, in particular on an terminal element described before or on an terminal element of a transfer system described before. The impact protection is swiveled about an axis parallel to the longitudinal axis of the terminal element, arranged on the guiding element, and in particular rotated or swiveled from a closed position into an impact position. Preferably, the impact protection is part of an impact element as described here.

The impact protection can be designed as a turned-down terminal device.

Horizontal swiveling about an axis parallel to the longitudinal axis makes it possible to bring the impact protection from a locking position into the impact position.

In a first step of the process, a locking device can be released, which is arranged in particular inside the guiding element. In a second step, a retaining device can be released. The locking device is preferably arranged inside an impact element which comprises the impact protection.

Before releasing the locking device, the terminal element can be swiveled sideways relative to the longitudinal axis (L).

Preferably, after pivoting the impact element, the impact element is locked wish a locking device to a further traffic barrier device in such a way that the impact element is fixed under pre-tension.

This enables to producing a reliable traffic barrier device. In a further step it is also conceivable to lock the impact element with a retaining device on the guiding element in such a way that further pivoting of the impact element is prevented. This allows for bringing the impact element into a stable position. The complete terminal element is therefore stable.

BRIEF DESCRIPTION OF THE DRAWINGS

The invention is explained in examples by means of the following figures. It shows

DETAILED DESCRIPTION OF THE PREFERRED EMBODIMENTS

Figure 1:
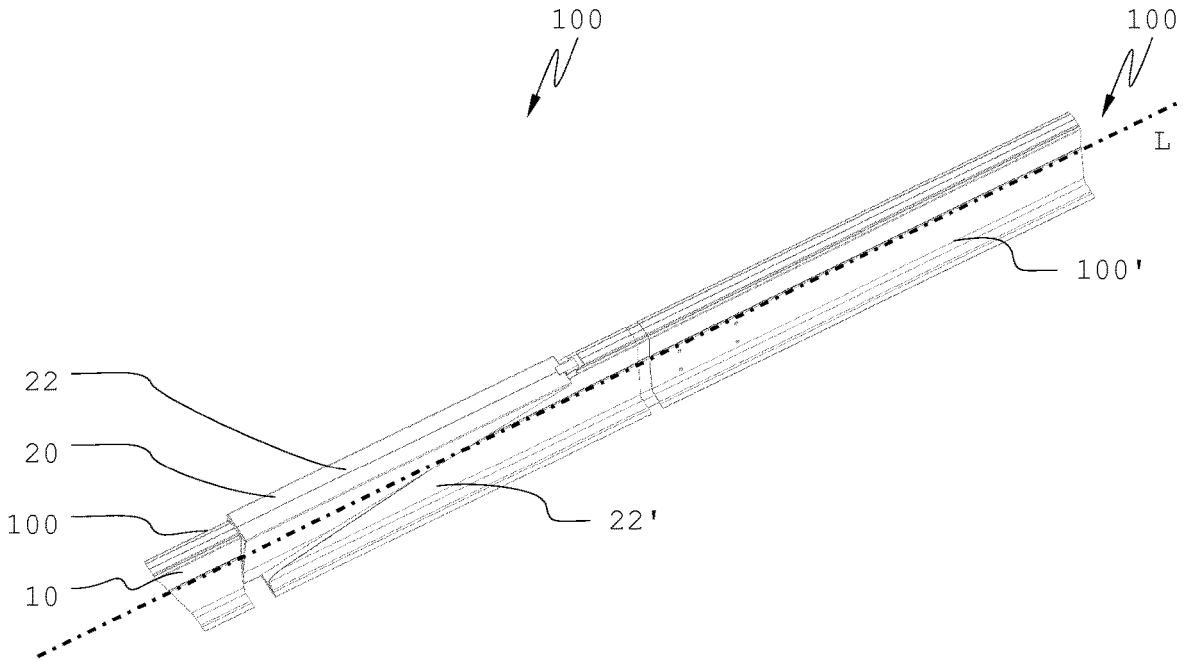
FIG. 1: A perspective representation of a terminal element.

FIG. 1 shows a terminal element 100 and an terminal element 100'. The longitudinal axis L extends along or through the terminal element 100. The terminal element 100 comprises a guiding element 10 and an impact element 20. The impact element is designed as a short turned-down terminal 22. The short turned-down terminal 22 is operatively connected to a short turned-down terminal 22' of the second terminal element (see FIG. 3).

Figure 2:
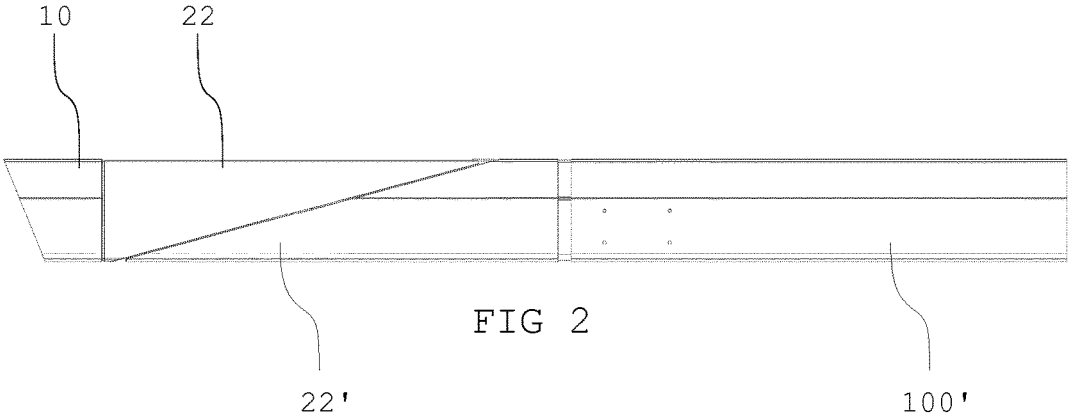
FIG. 2: A side view of the terminal element from FIG. 1.

FIG. 2 shows a side view of the terminal elements 100 and 100' of FIG. 1. The terminal element is in an intended position, i.e. it stands, for example, on a base.

Figure 3:
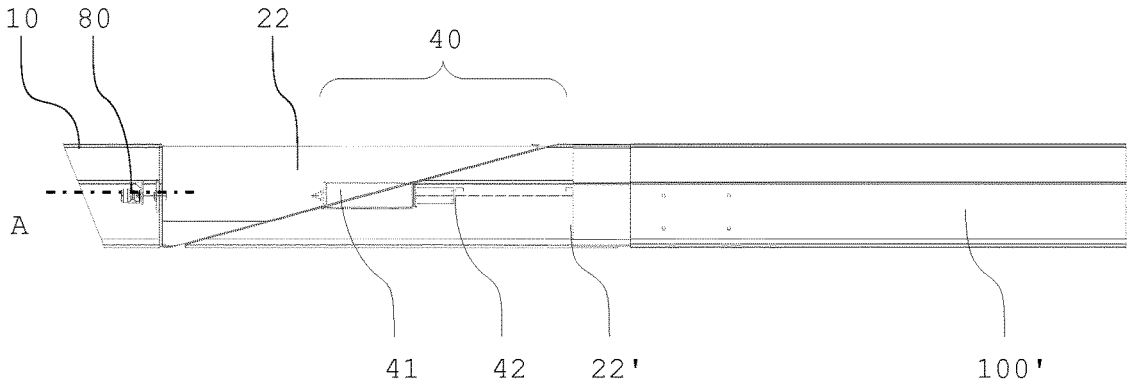
FIG. 3: The view according to FIG. 2 with partially blanked out elements.

FIG. 3 shows the terminal elements 100 and 100' of FIG. 2, whereby various elements of the terminal, elements 100 and 100' are blanked out. A part of the guiding element 10, a part of the short turned-down terminal 22 and a part of the short turned-down terminal 22' are blanked out. A locking device 40 is arranged on the impact element 20. A first element of the locking device 40, namely a cylinder 42, is arranged within the short turned-down terminal 22' of the impact element 100'. In the rear area of the impact element 20, located within the guide element 10, there is a retaining device for retaining a relative movement between the guide element 10 and the short turned-down terminal 22.

A hydraulic drive 80 is arranged inside the guiding element. Within the guiding element 10 there is also a hydraulic unit, which is not further described in detail, with which, for example, the drive 80 can be driven. The hydraulic unit can also be used to operate the retaining device.

In addition, a further hydraulic unit is arranged in the 100' impact element, which is not described in detail, and with which the cylinder 12 of the locking device 40 can be driven.

The procedure for opening a passageway in a traffic barrier device 1 (see FIGS. 7 to 9) is described in she following.

Figure 4:
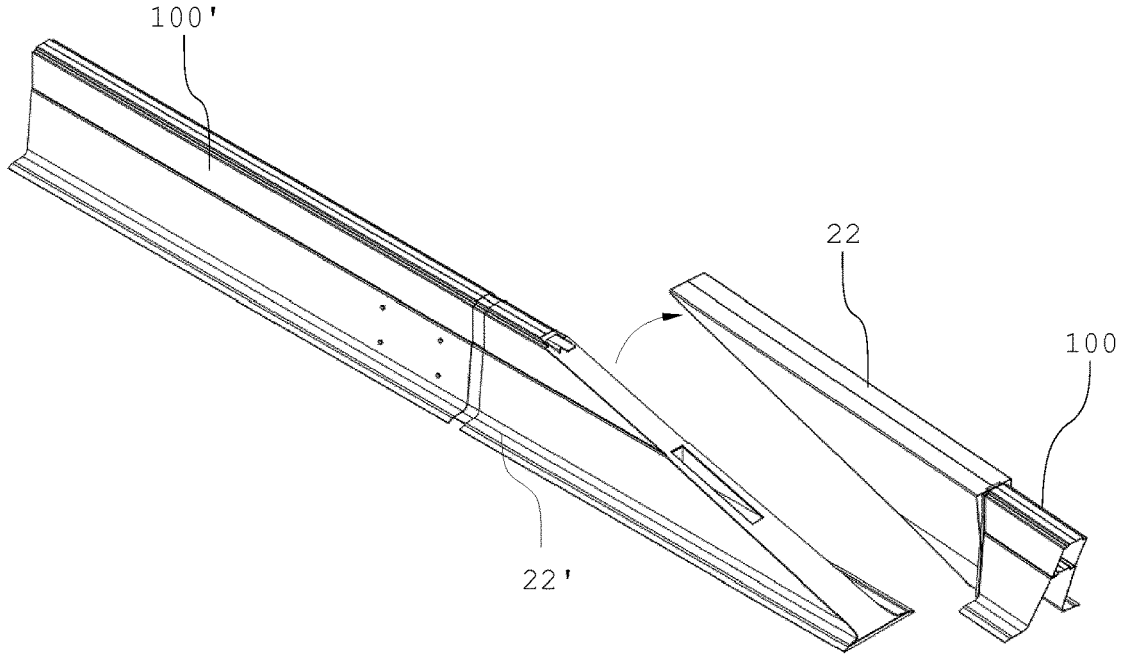
FIG. 4: A perspective view of the terminal elements according to FIG. 1 in a shifted position.
Figure 5:
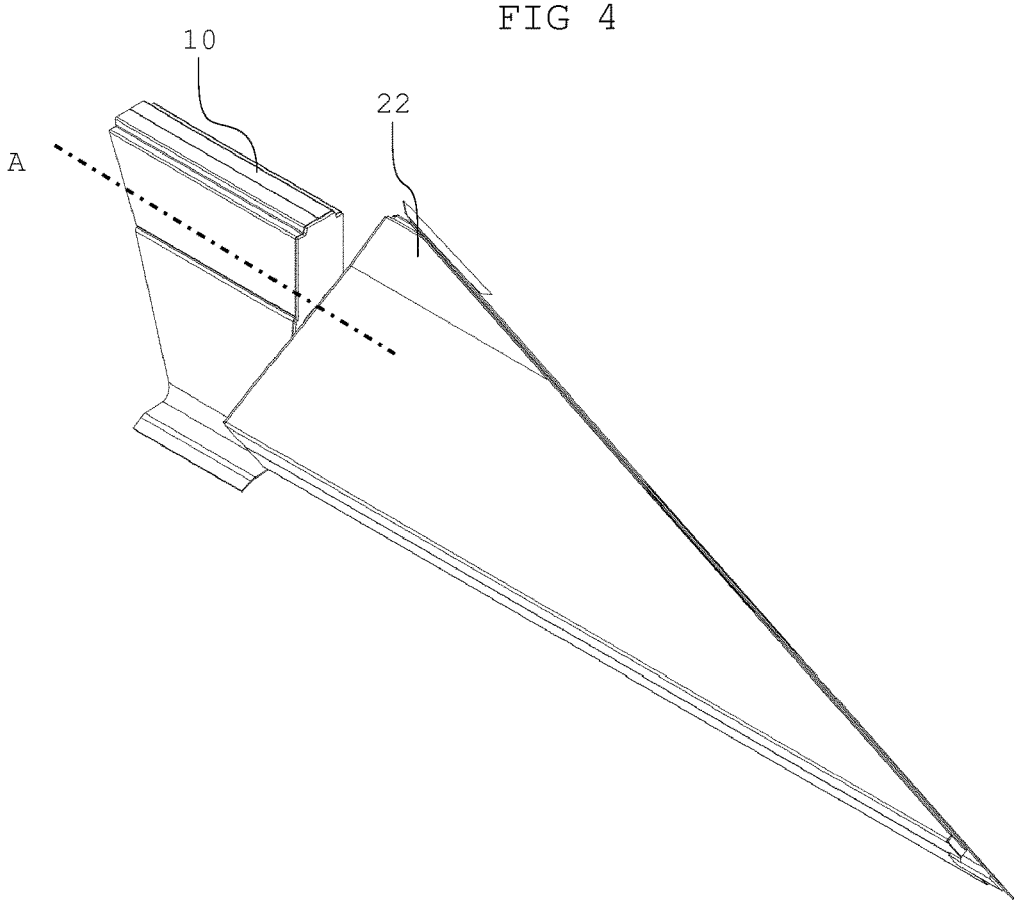
FIG. 5: A perspective view of the terminal element as shown in FIG. 1 during the swiveling process of the impact element.

FIG. 4 shows a perspective view of the terminal elements 100 and 100' according to FIG. 1 in a shifted position. In a first step, the locking device 40 (see FIG. 3) was released so that she terminal elements 100 and 100' are separated from each other. FIG. 4 shows that the terminal element 100 is swiveled about a vertical axis B (see FIG. 7) relative to the terminal element 100'. Short turned-down terminal 22 is shifted relative to short turned-down terminal 22' in the direction of the arrow.

Figure 6:
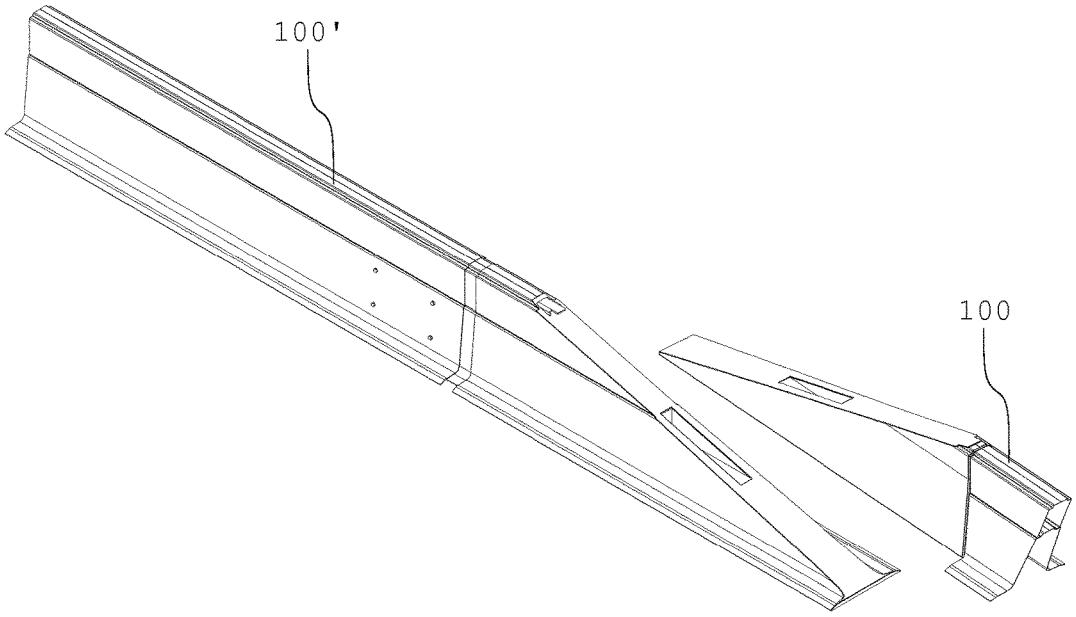
FIG. 6: A detailed view of the terminal element as shown in FIG. 1 during the swiveling process of the impact element.

FIG. 6 shows a detailed view of the terminal, element 100. The short turned-down terminal 22 is rotated about a longitudinal axis A in relation to the guide element 10. Compared to the position of the short turned-down terminal 22 as shown in FIG. 4, it is rotated 180° about the longitudinal axis so that its position corresponds to that of the short turned-down terminal 22' in FIG. 4. In this end position, she short turned-down terminal is preferably secured against unintentional rotation with a retaining device. The terminal element is then swiveled further around axis 70 until a desired end position is reached (see FIGS. 8*a*, 8*b* and 9, for example).

Figure 7:
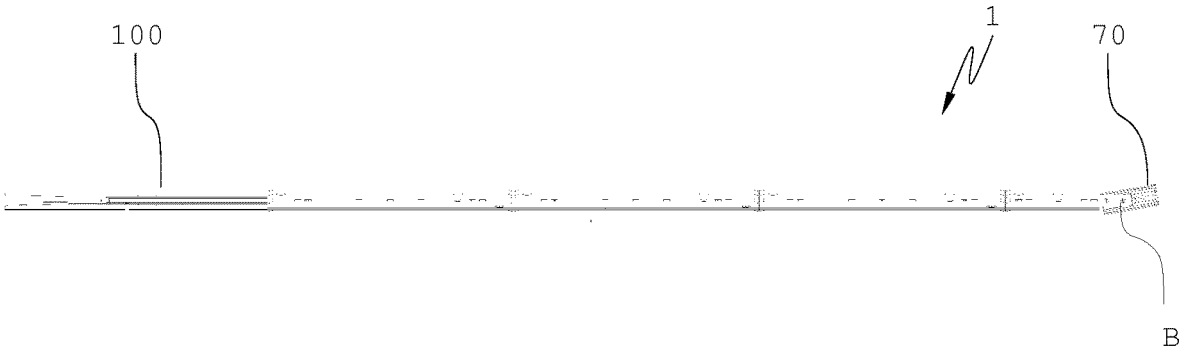
FIG. 7: A traffic barrier element.

FIG. 7 shows a traffic barrier device 1 with a terminal element 100, several intermediate elements not described any further and a stationary element 70. A vertical axis of rotation. B is provided on the stationary element 70, on which the terminal element 100 can be swiveled with the other intermediate elements.

Figure 8A:
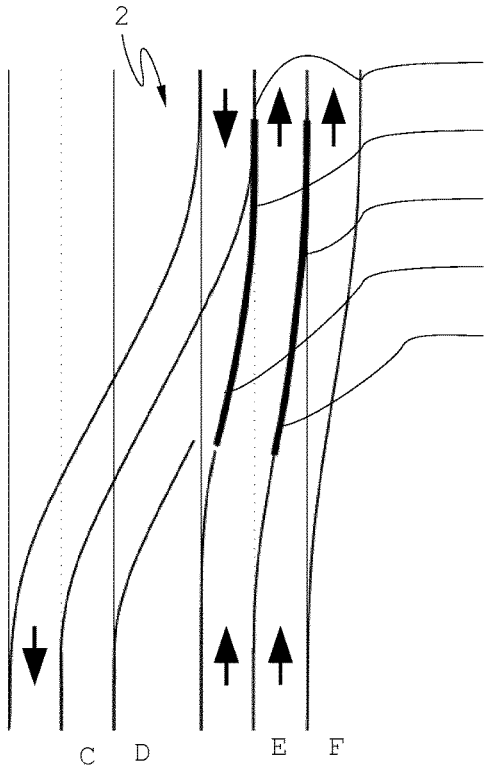
FIG. 8: A transition system in two positions (FIG. 8*a* and FIG. 8*b*)
Figure 8B:
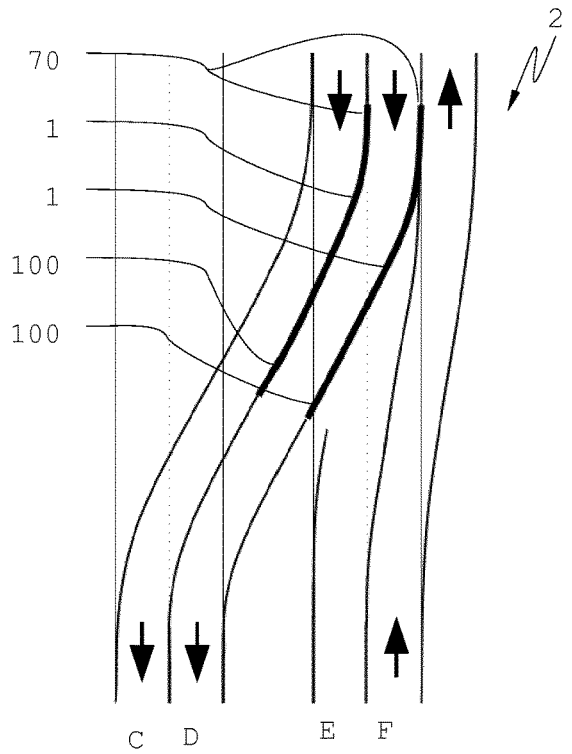

FIGS. 8*a* and 8*b* show a transition system 2 comprising several traffic barrier devices 1. The transition system is designed as shown in PCT/EP 2017/050042. For shifting, a trolley is designed according to the trolley PCT/EP 2017/050042. The transition system of FIG. 8*a* shows the state prior to the operation of the transition system and FIG. 8*b* shows the state after the operation of the transition system 2. The transition system 2 as shown in FIGS. 8*a* and 8*b* is designed to divert a four-lane carriageway into a three-lane carriageway. The four-lane lane shown in FIG. 8*a* comprises lanes C, D, E, and F. It may be necessary to divert lane E into lane D, for example. This is desirable, for example, depending on the volume of traffic. If, for example, traffic moves in the morning towards town (here in the direction of the three lanes), it is advantageous if, for example, two fanes can be used in this direction. In the evening the situation is typically the other way around.

The transition system 2 comprises two lane limiting devices 1 in each case. These are each mounted at a stationary element 70 at a second vertical rotary axis (see FIG. 7). The traffic barrier device 1 comprises a terminal element 100 at each of its ends. The terminal element 100 can be locked with another traffic barrier element by means of the locking device 40 (see, for example, FIG. 4). For example, the other traffic barrier elements have further/second elements of the locking device.

As can be seen from FIGS. 8*a* and 8*b*, a transition system 2 as described herein can be used to direct the middle lane of the three-lane side either to lane D or to lane E. The middle lane of the three-lane side can be directed either to lane D or to lane E using a transition system 2 as described herein. This enables regulation or control of traffic.

Figure 9:
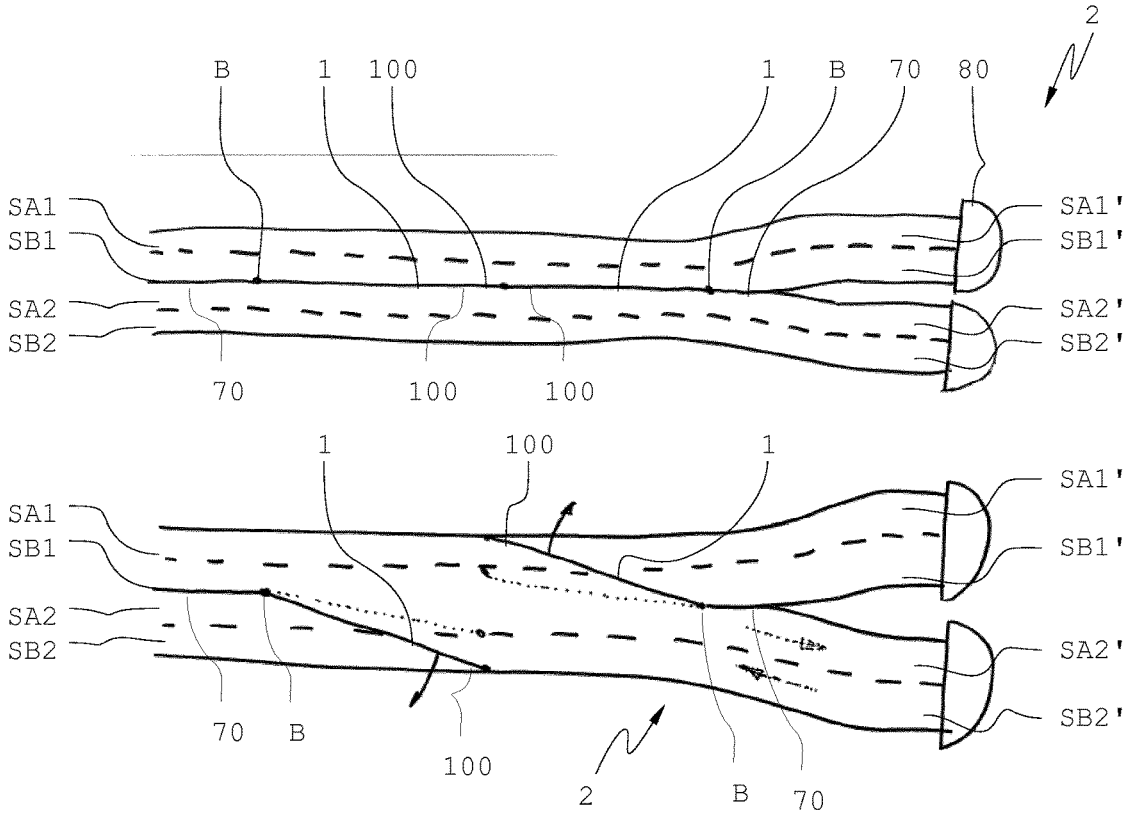
FIG. 9: An alternative embodiment of a transition system.

FIG. 9 shows an alternative embodiment of a transition system 2. The transition system 2 comprises two traffic barrier devices 1 (see also FIG. 7). The transition system is located in front of a directionally separated tunnel with two tunnel tubes 80 (referenced only once). Each tunnel has one carriageway with two lanes each, SA1 and SB1 as well as SA2 and SB2. At the tunnel entrance each lane is marked with a '. The driving directions can be assumed in FIG. 9 in the upper lane from SA1 and SB1 in direction SA1' and SB1' (normal traffic) and in the lower lane from SA2' and SB2' in direction SA2 and SB2 (oncoming traffic).

The traffic barrier devices 1 are each connected to a stationary element 70 with a vertical axis of rotation B so that they can be rotated or pivoted (see also FIG. 7).

FIG. 9 above shows the transition system 2 in its original position, FIG. 9 below shows two possible end positions. In the original position, the traffic barrier devices with their terminal elements 100 are connected to each other at their ends. This means that impact elements 20 are in their closed position (see FIGS. 1 and 6) and are connected at their ends so the locking devices 42 (see FIGS. 4 and 6).

In the first end position, (extended view) both tracks SA1 and SB1 are redirected to tracks SA2' and SB2'. The oncoming traffic originally on the SA2' and SB2' lanes has been stopped or diverted, for example, before the second end of the tunnel, not shown here. For this purpose, the respective traffic barrier devices 100 are swiveled over the entire carriageway so that they extend over both lanes SA1 and SB1, or SA2 and SB2, respectively, for each carriageway.

In the second or alternative end position, the traffic barrier devices 100 are only swiveled to the middle of the lane, i.e. only over one lane, namely SB1 and SA2. This allows traffic to be routed in both directions in one of the two tunnels. In a first step, a second tunnel end, located at the second tunnel end not shown here, i.e. at the tunnel entrance for oncoming traffic, is actuated by a transition device 2. The two lanes SA2' and SB2' are merged and directed to the SB2' lane. This means that the oncoming traffic arrives at the end of the tunnel shown in FIG. 12 only on the SB2' lane, the SA2' lane remains free. To ensure safe traffic guidance, the lanes SA1 and SB1 are directed to the individual lane SB1 in a next step and then directed to the lane SA2'. There is now oncoming traffic in the tunnel (dashed arrows).

The invention claimed is:

1. A transition system comprising at least one traffic barrier means having a terminal element, wherein the terminal element has a longitudinal axis, wherein the terminal element comprises:

a guiding element, and an impact element, which is rotatable or pivotable relative to the guiding element from a closed position into an impact position, wherein an impact side of the impact element faces oncoming traffic in the impact position, wherein the impact element is mounted on the guide element so as to be rotatable or pivotable about an axis parallel to the longitudinal axis or about the longitudinal axis, wherein the traffic barrier means has a vertical axis of rotation on a side remote from the terminal element for pivoting the traffic barrier means relative to a stationary element of the transition system which is completely fixed, wherein the terminal element is fitted with a running gear, wherein the terminal element is pivotable by the running gear around the vertical axis of rotation when the impact element is rotated, wherein the impact element essentially is wedge-shaped such that a height extension of the impact element changes along the direction of the longitudinal axis gradually across the entire length of the impact element, wherein the impact side is the longest side of the wedge.

2. The transition system according to claim 1, wherein the impact element extends along the longitudinal axis in the closed position and in the impact position.

3. The transition system according to claim 1, wherein the impact element is lockable in at least one of the closed position and the impact position.

4. The transition system according to claim 1, wherein the impact element has at least one first element of a retaining device.

5. The transition system according to claim 4, wherein the first element of the retaining device is designed as a retaining opening or as a retaining cylinder.

6. The transition system according to claim 5, wherein a second element of the retaining device is arranged inside the impact element.

7. The transition system according to claim 1, wherein the impact element comprises at least a first element of a locking device.

8. The transition system according to claim 7, wherein the first element of the locking device is designed as a locking bolt or as a cylinder.

9. The transition system according to claim 7, wherein the first element of the locking device is arranged inside the impact element.

10. The transition system according to claim 7, wherein the impact element has a turned-down terminal.

11. The transition system according to claim 10, wherein the first element of the locking device is disposed in the turned-down terminal.

12. The transition system according to claim 1, wherein the guiding element has an end section at which the impact element is arranged.

13. A method for providing an impact protection on a terminal element of a transition system according to claim 1, wherein the impact element is rotated or pivoted from the closed position into the impact position about a horizontal axis arranged on the guiding element, wherein the impact side of the impact element faces oncoming traffic in the impact position.

14. The method according to claim 13, wherein in a first step a locking device is released.

15. The method according to claim 14, wherein a retaining device is released in a second step.

16. The method according to claim 15, wherein, before the retaining device is released, the terminal element is pivoted laterally with respect to the longitudinal axis.

17. The method according to claim 13, wherein after the pivoting of the impact element, the impact element is locked to a further traffic barrier device, by a locking device, in such a way that the impact element is fixed under prestress.

18. The method according to claim 13, wherein after the pivoting of the impact element, the impact element is locked, via a retaining device, on the guiding element in such a way that further pivoting of the impact element is prevented.

* * * * *